US012071868B2

(12) United States Patent
Preuß

(10) Patent No.: US 12,071,868 B2
(45) Date of Patent: Aug. 27, 2024

(54) SHAFT ADJUSTER

(71) Applicant: Schaeffler Technologies AG & Co. KG, Herzogenaurach (DE)

(72) Inventor: Tobias Preuß, Röttenbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 123 days.

(21) Appl. No.: 17/796,321

(22) PCT Filed: Jan. 20, 2021

(86) PCT No.: PCT/DE2021/100061
§ 371 (c)(1),
(2) Date: Jul. 29, 2022

(87) PCT Pub. No.: WO2021/151427
PCT Pub. Date: Aug. 5, 2021

(65) Prior Publication Data

US 2023/0101883 A1 Mar. 30, 2023

(30) Foreign Application Priority Data

Jan. 30, 2020 (DE) ..... 10 2020 102 265.4

(51) Int. Cl.
*F01L 1/352* (2006.01)

(52) U.S. Cl.
CPC ..... *F01L 1/352* (2013.01); *F01L 2303/01* (2020.05); *F01L 2303/02* (2020.05)

(58) Field of Classification Search
CPC ..... F01L 2303/01; F01L 1/352
See application file for complete search history.

(56) References Cited

U.S. PATENT DOCUMENTS

| | | | |
|---|---|---|---|
| 1,648,715 | A | 11/1927 | Bean |
| 2,343,110 | A | 2/1944 | Hale |
| 3,359,819 | A | 12/1967 | Veillette et al. |
| 2012/0291729 | A1 | 11/2012 | David et al. |

FOREIGN PATENT DOCUMENTS

| | | | |
|---|---|---|---|
| CN | 103775610 | A | 5/2014 |
| CN | 105464735 | A | 4/2016 |
| CN | 106195134 | A | 12/2016 |
| CN | 107923273 | A | 4/2018 |
| DE | 102013110396 | A1 | 4/2014 |
| DE | 102013215623 | A1 | 2/2015 |
| DE | 102013017544 | A1 | 4/2015 |
| DE | 102015007169 | A1 | 1/2016 |
| DE | 102014018312 | A1 | 6/2016 |
| DE | 102016217051 | A1 | 8/2017 |
| DE | 102016204426 | A1 | 9/2017 |
| DE | 102017111035 | B3 | 6/2018 |
| DE | 102018102774 | B3 | 6/2019 |
| DE | 102019105760 | A1 | 9/2019 |
| DE | 102018108564 | A1 | 10/2019 |
| EP | 0079184 | A1 | 5/1983 |
| WO | 2013088421 | A2 | 6/2013 |

*Primary Examiner* — Ngoc T Nguyen

(57) ABSTRACT

The disclosure relates to a shaft adjuster, in particular a camshaft adjuster, comprising a drive gear having a spur gear toothing and a clamping gear which is arranged coaxially relative to the drive gear and which is loaded by a spring acting in the circumferential direction. The spring is also designed as an axial securing element for axially securing the clamping gear on the drive gear.

19 Claims, 6 Drawing Sheets

SHAFT ADJUSTER

CROSS-REFERENCE TO RELATED APPLICATIONS

This application is the U.S. National Phase of PCT Application No. PCT/DE2021/100061 filed on Jan. 20, 2021, which claims priority to DE 10 2020 102 265.4 filed on Jan. 30, 2020, the entire disclosures of which are incorporated by reference herein.

TECHNICAL FIELD

The disclosure relates to a shaft adjuster, in particular a camshaft adjuster.

BACKGROUND

A generic shaft adjuster is known from DE 10 2014 018 312 A1. This is a camshaft adjuster that has what is termed a chamber body as a drive gear. The chamber body is driven by the crankshaft of an internal combustion engine via a spur gear toothing. The camshaft of the internal combustion engine is adjusted hydraulically, wherein the camshaft is connected to a vane body arranged in the chamber body. In addition to the chamber body, the known camshaft adjuster has a compensating gear braced against the chamber body, which meshes with the gear wheel of the spur gear driving the camshaft with which the toothing of the chamber body also meshes. The compensating gear, i.e., the clamping gear, is braced against the chamber body by means of a clamping spring acting as a torsion spring, wherein the clamping spring engages in a receptacle formed on an inner peripheral surface of the chamber body. Furthermore, a stop shoulder for the clamping spring is formed on the inner peripheral surface of the chamber body. A second stop shoulder is located in the compensating gear.

A further camshaft adjuster, which has two mutually preloaded gear wheels arranged next to one another, namely a main gear as a drive gear and a compensating gear as a clamping gear, is described in DE 10 2013 017 544 A1. In this case, too, the spring preload between the drive gear and the clamping gear serves to remove play from a spur gear toothing. In order to fix the drive gear in a defined angular position relative to the clamping gear for assembly purposes, a securing element is provided that, in the case of DE 10 2013 017 544 A1, can be actuated without tools.

An electromechanical shaft adjuster, namely a camshaft adjuster, is disclosed, for example, in DE 10 2016 204 426 A1. In this case, an adjusting shaft is designed as a hollow shaft.

Further electromechanical camshaft adjusters are disclosed in DE 10 2019 105 760 A1 and DE 10 2018 108 564 A1. In both cases, a harmonic drive is provided as the actuating gear of the respective shaft adjuster.

SUMMARY

The disclosure is based on the object of specifying a shaft adjuster that has been developed further than the prior art and has a clamping gear that can be rotated at least slightly in relation to a drive gear, which is characterized by particular ease of assembly and a compact, parts-saving design.

According to the disclosure, this object is achieved by a shaft adjuster described herein. The shaft adjuster, which is in particular a camshaft adjuster for an internal combustion engine, comprises, in a basic concept known per se, a drive gear having a spur gear toothing and a clamping gear arranged coaxially relative to the drive gear and loaded by a spring acting in the circumferential direction. According to the disclosure, the spring is also designed as an axial securing element for axially securing the clamping gear on the drive gear.

A separate securing element for axially securing the clamping gear relative to the drive gear is not provided. The spring describes an open ring shape, i.e., a C-shape. The double function of the spring, i.e., the preloading function as a torsion spring and the function of an axial securing ring, is provided without additional production costs in comparison to a conventional preload spring.

In an example embodiment, the spring engages in a tangential groove arranged on the outer peripheral surface of the drive gear, which is formed in an annular projection of the drive gear that protrudes beyond the spur gear teeth in the axial direction, wherein the clamping gear is arranged in the axial direction between the spur gear toothing of the drive gear and the essentially annular spring.

In order to support the spring on the drive gear in the circumferential direction, the tangential groove can be interrupted by an axial groove into which a first securing end of the spring directed radially inwards engages. The securing end of the spring, which is drawn radially inwards, can be rounded off at least on its inner contour interacting with the axial groove. The rounded design of the securing end provides a soft stop for the C-spring on the drive gear.

In an example embodiment, an insert is inserted or pressed into the axial groove, wherein the spring is supported on the insert. In this case, the end of the spring supported on the drive gear is not pulled inwards. The same also applies in cases in which a contour that assumes the function of the insert part represents an integral part of the drive gear.

A stop, i.e., a contour for torque support, which is located on the clamping gear, can be designed in such a way that one end of the C-shaped spring, i.e., the C-spring, engages radially from the inside into said contour. The contour, i.e., the torque support contour, can protrude beyond the toothing of the clamping gear in its axial direction and can be produced, for example, by sintering. A machining production of the torque support contour is also possible.

According to an example embodiment, the torque support contour of the clamping gear is interrupted by an opening in the clamping gear, which is provided for the insertion of a securing element and is aligned with an opening located in the drive gear. The securing element is required to assemble the shaft adjuster and is removed after assembly is complete.

The shaft adjuster can be designed as an electromechanical adjuster. A harmonic drive designed as a reduction gear is provided, for example, as the actuating gear of the adjuster. With regard to possible configurations of harmonic drives for camshaft adjusters, reference is made to the documents DE 10 2016 217 051 A1 and DE 10 2017 111 035 B3 in addition to the prior art already mentioned.

The harmonic drive of the wave adjuster can have an inner toothing formed on the inner peripheral surface of the drive gear, which meshes with a flexible, externally toothed gear element of the harmonic drive.

According to an example embodiment of the wave adjuster comprising a harmonic drive, the harmonic drive comprises a compensating clutch with a compensating element in the form of an Oldham disc, which is arranged entirely in the interior space of the harmonic drive formed by the drive gear. With regard to a possible design of a compensating clutch for a shaft adjuster, reference is made to document DE 10 2013 215 623 A1 by way of example. In an alternative embodiment, instead of the Oldham disc on the transmission, a compensating element is arranged on an electric motor, with which a wave generator of the harmonic drive is actuated.

The advantage of the disclosure lies in particular in the fact that a camshaft drive, which works with a spur gear toothing and comprises an adjuster for varying the phase position of the camshaft relative to the crankshaft of an internal combustion engine, is both compact and constructed with a small number of parts and can also be operated with particularly low noise. The low-noise running is largely due to the fact that two gears, which have the same profile, namely the drive gear and the clamping gear, mesh with another gear, which in the present case is firmly connected to the crankshaft or is driven by the crankshaft, in such a way that left and right tooth flanks of the other gear simultaneously contact the arrangement of the two mutually coaxial, mutually braced gears.

BRIEF DESCRIPTION OF THE DRAWINGS

In the following, an exemplary embodiment of the disclosure is explained in more detail by means of a drawing. In the figures, partly simplified.

DETAILED DESCRIPTION

Figure 1:
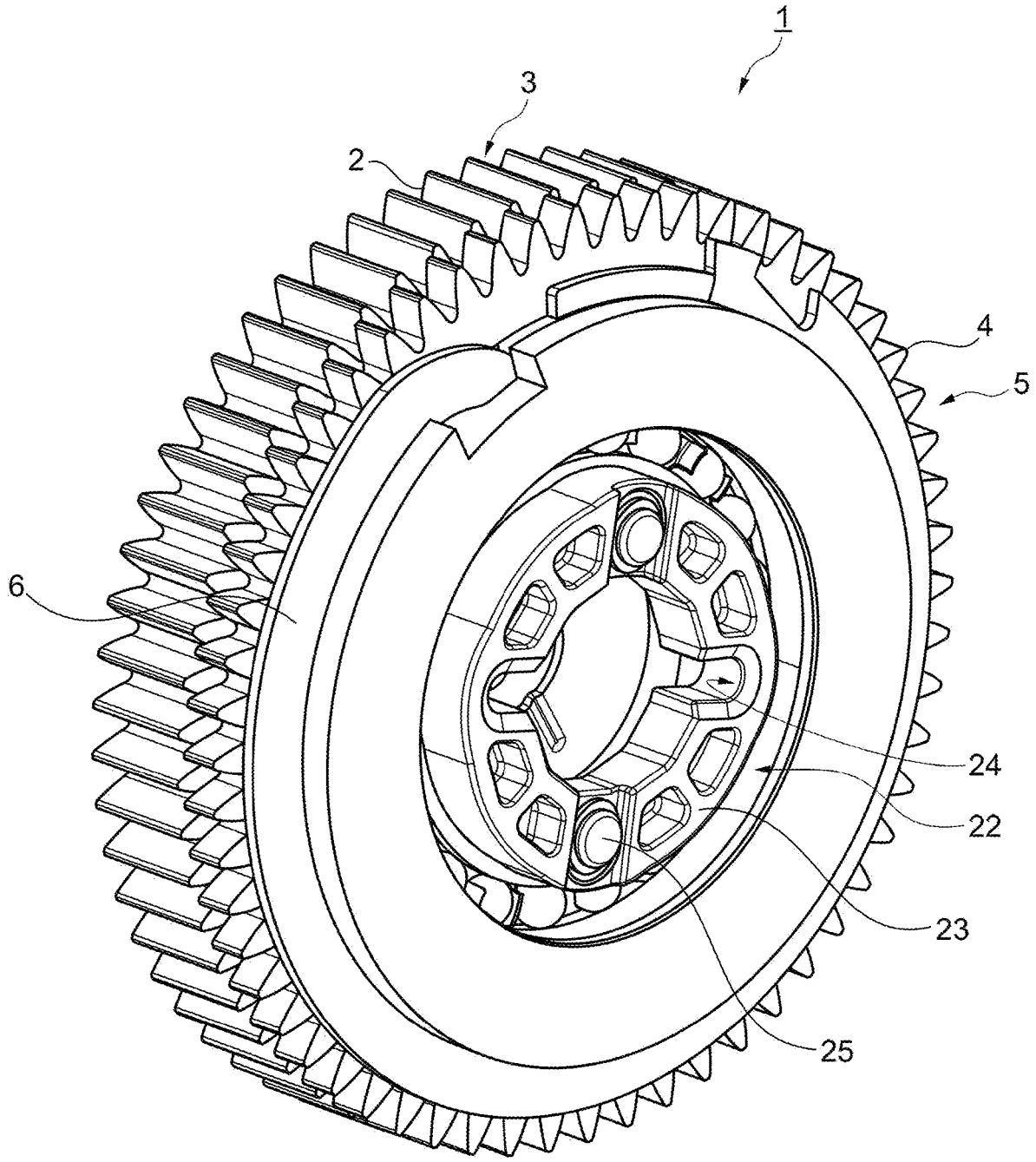
FIG. 1 shows a perspective view of a shaft adjuster, in particular a camshaft adjuster.
Figure 2:
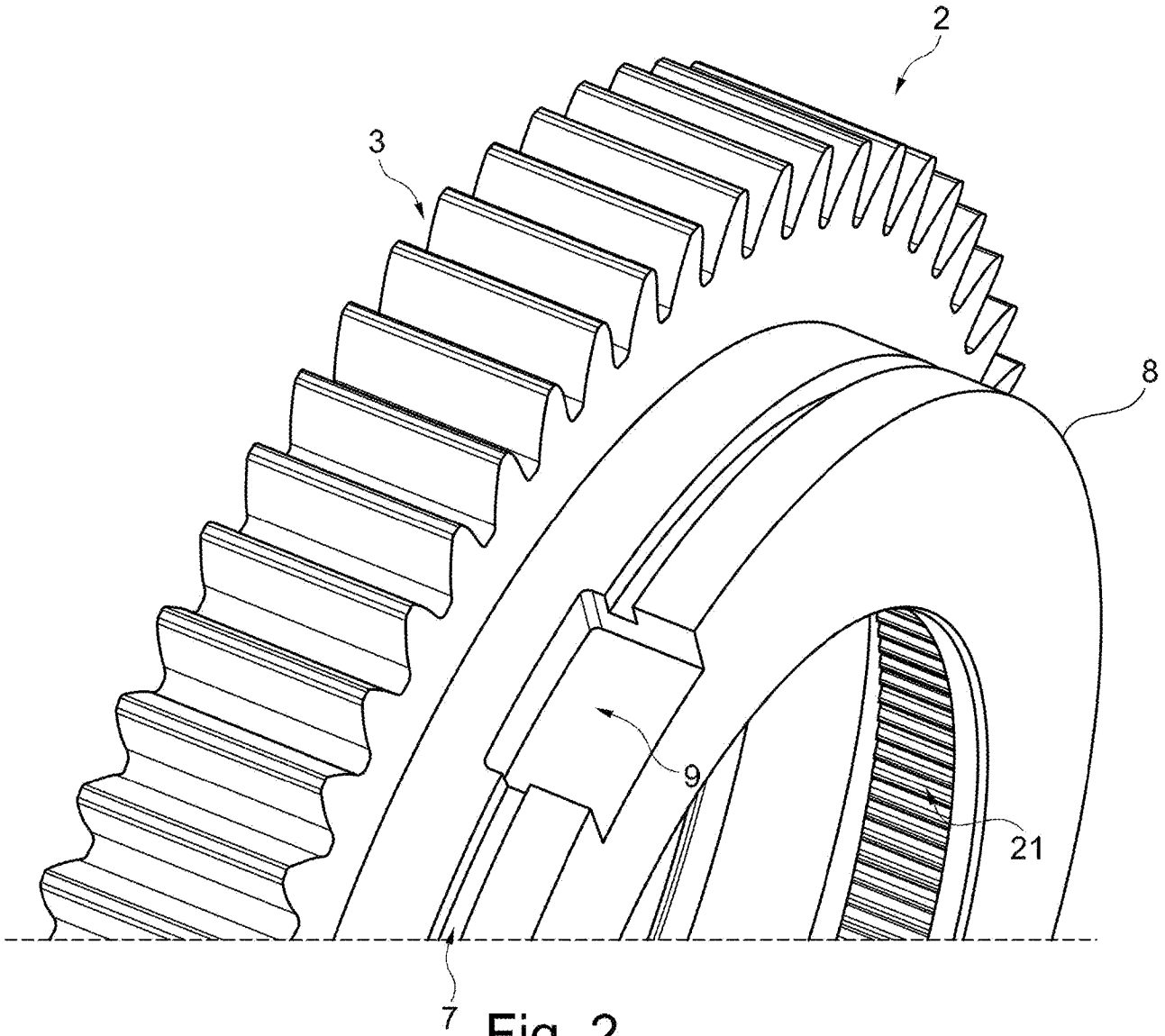
FIG. 2 shows a detail of a drive gear of the shaft adjuster.
Figure 3:
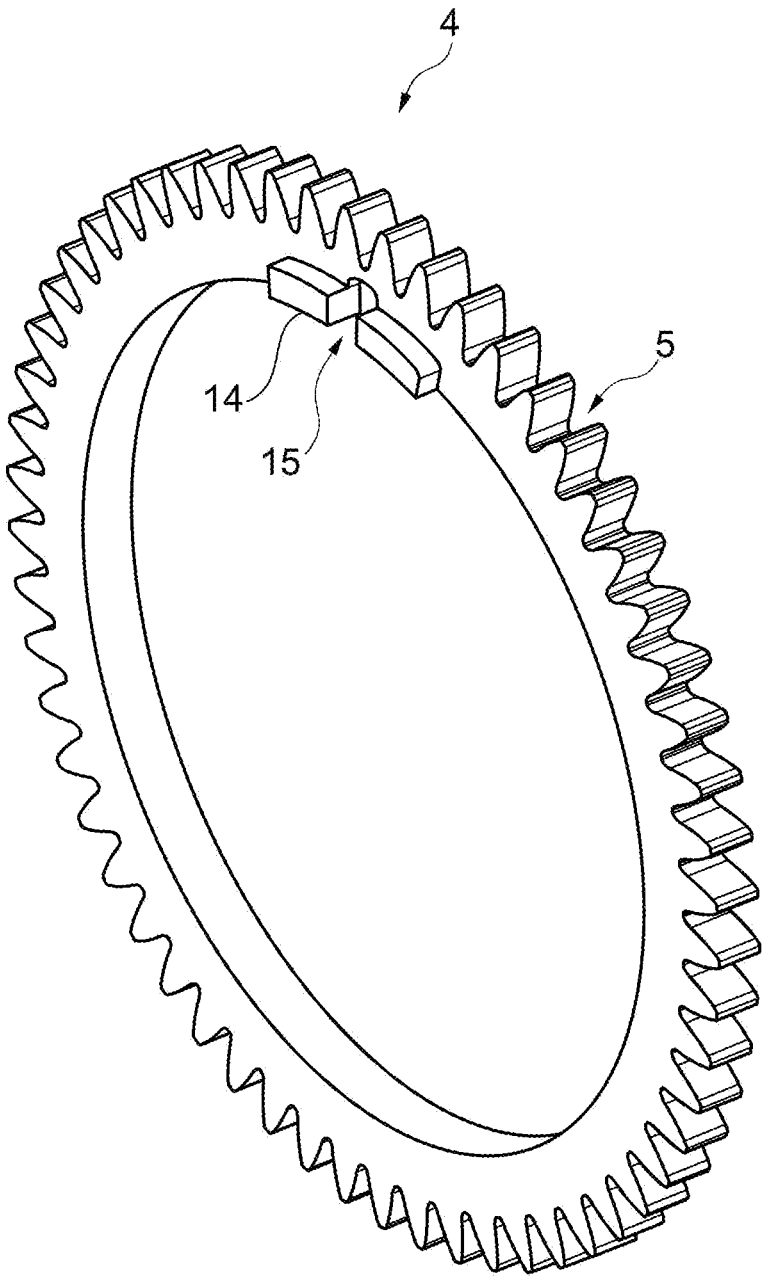
FIG. 3 shows a clamping gear of the shaft adjuster.
Figure 4:
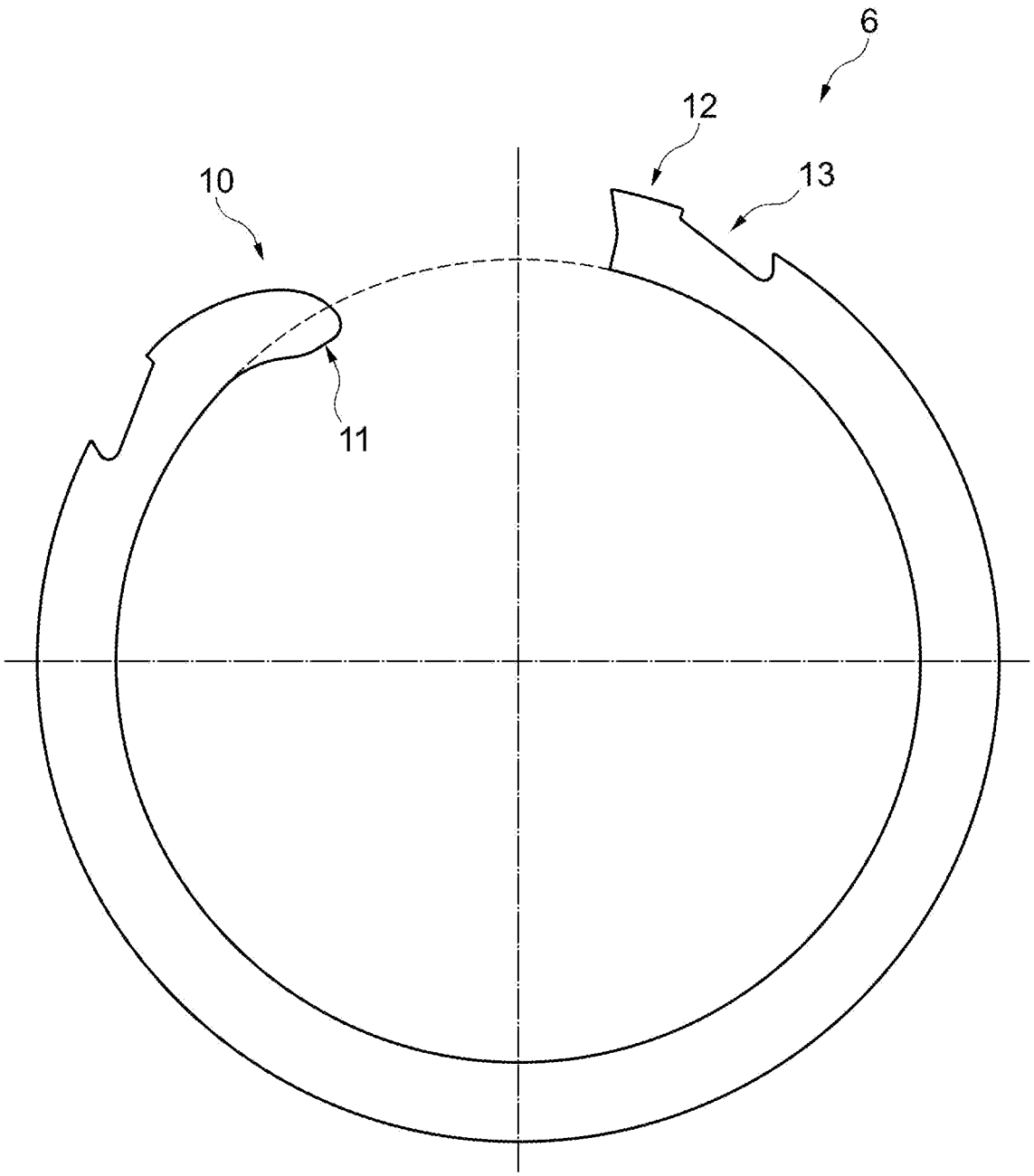
FIG. 4 shows a C-spring of the shaft adjuster.
Figure 5:
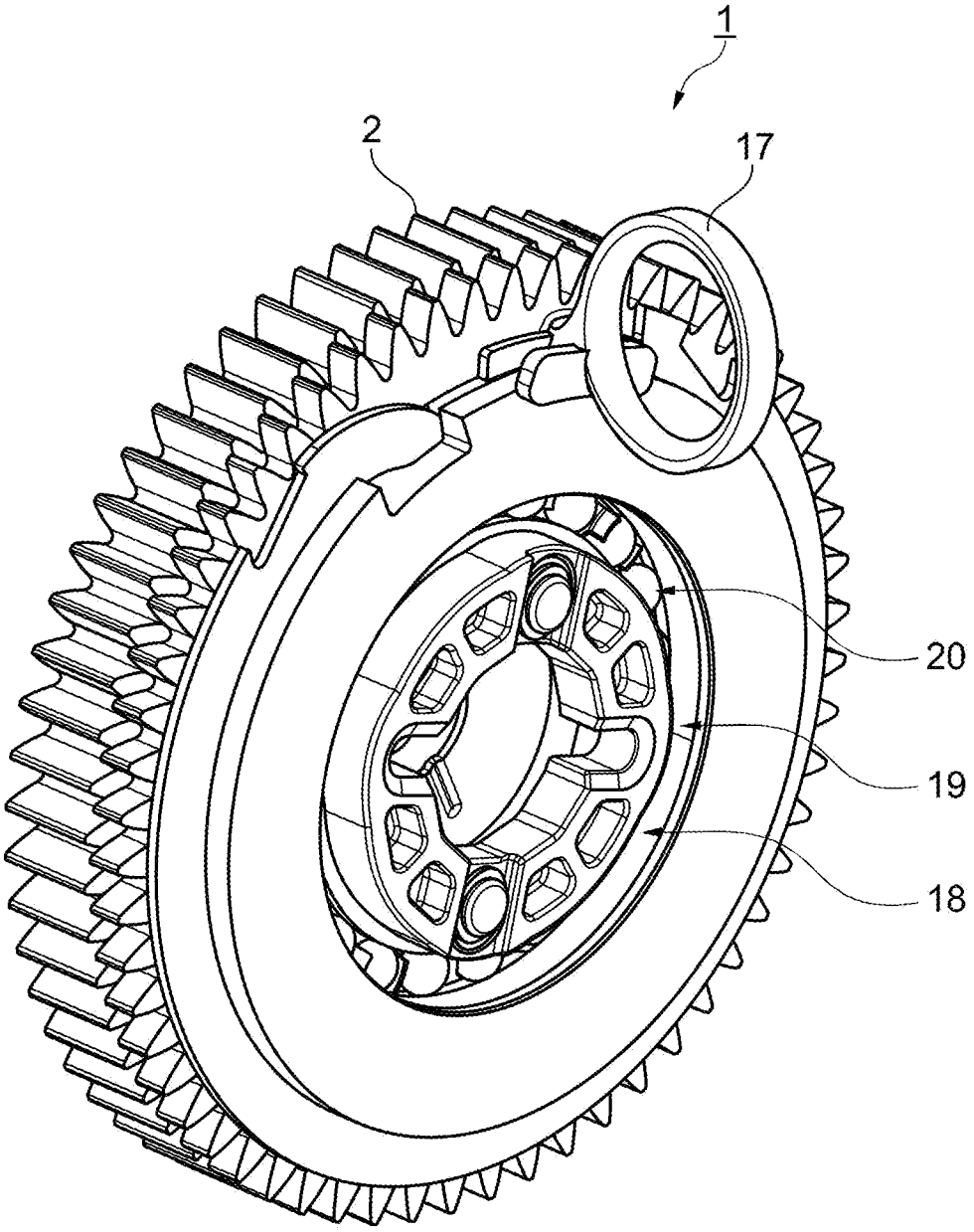
FIG. 5 shows the shaft adjuster including a securing element.
Figure 6:
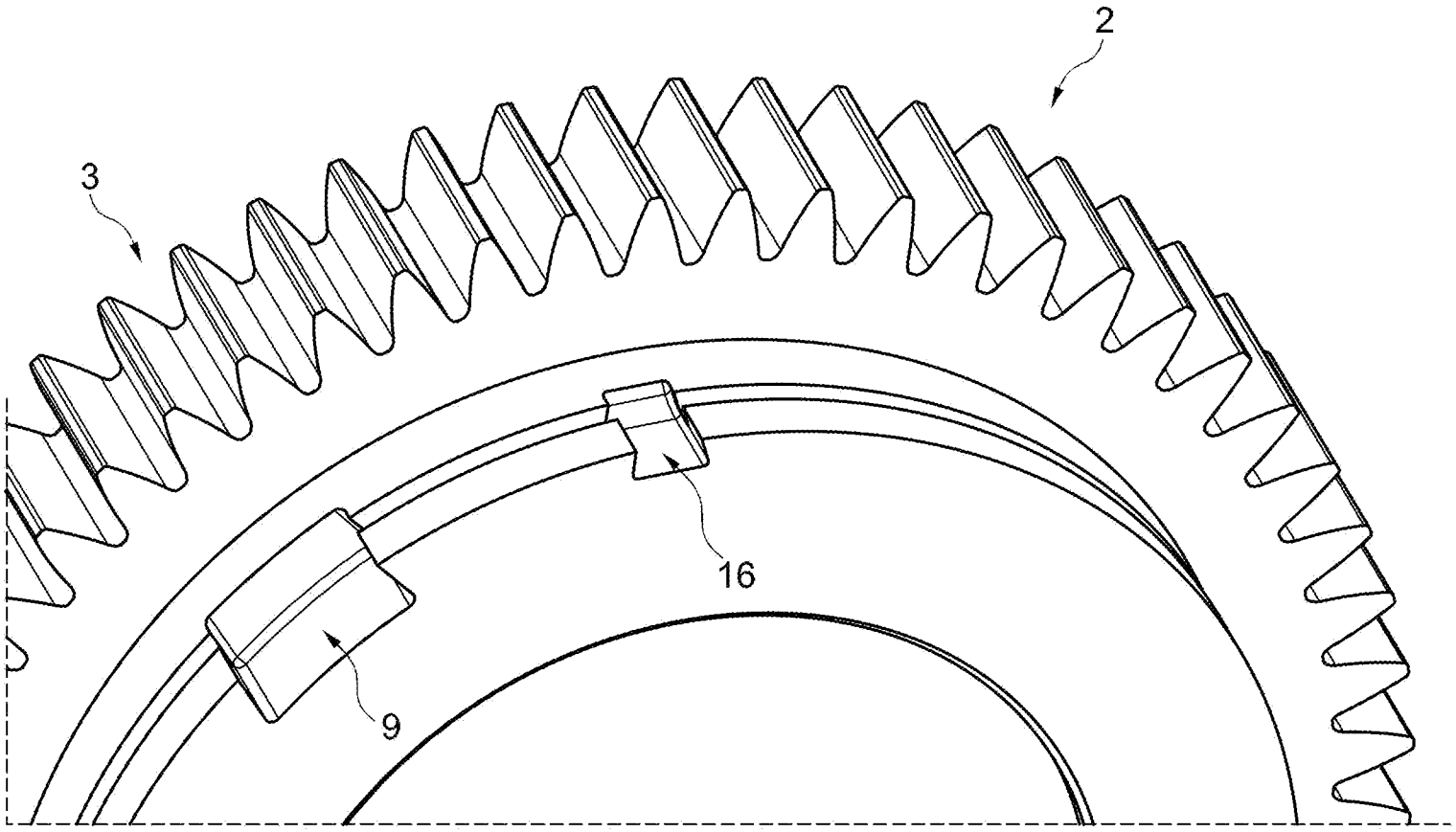
FIG. 6 shows a detail view of the arrangement according to FIG. 5.

A shaft adjuster identified overall by the reference numeral 1 is provided as an electromechanical camshaft adjuster for use in a reciprocating piston engine of a motor vehicle. With regard to the principal function of the camshaft adjuster 1, reference is made to the prior art cited at the outset.

The shaft adjuster 1 comprises a drive gear 2, which is provided with a spur gear toothing 3 and is driven via a gear drive from the crankshaft of the reciprocating engine. In order to take play out of the gear drive, there is another, narrower gear wheel next to the drive gear 2, namely the clamping gear 4, the toothing of which is labeled with the reference symbol 5 and has the same profile as the toothing 3 of the drive gear 2.

The two gear wheels 2, 4 are biased against each other in the circumferential direction by a C-shaped spring 6 acting as a torsion spring, i.e., a C-spring, so that a driven gear, not shown, of the gear drive, which meshes with both the toothing 3 and the toothing 5, cooperates with the arrangement of the two gear wheels 2, 4 without play.

The spring 6 snaps into a tangential groove 7 of the drive gear 2. The tangential groove 7 is located in an annular projection 8, which is integrally connected to the rest of the drive gear 2 and protrudes beyond the spur gear toothing 3 in the axial direction, relative to the central axis of the gear wheels 2, 4, which is also the central axis of the entire shaft adjuster 1. The clamping gear 4 is arranged axially between the spur gear toothing 3 and the C-spring 6. This prevents displacement of the clamping gear 4 on the annular projection 8 in the axial direction, on the one hand, by the spur gear toothing 3 and, on the other hand, by the C-spring 6.

The tangential groove 7 is interrupted by an axial groove 9, which is used to mount a first securing end 10 of the spring 6. In contrast to the axial groove 9, which has a rectangular cross section, the securing end 10 of the spring 6 is rounded and drawn inwards. This means that in the area of the securing end 10 the inside diameter of the spring 6 is reduced in comparison to other areas of the spring 10. A rounded inner contour of the securing end 10 is labeled with reference symbol 11. The second securing end of the spring 6, labeled with the reference symbol 12, has a recess 13 on the outside, which engages in a torque support contour 14 of the clamping gear 4 from the inside. The torque support contour 14 has the shape of a ring segment, which is interrupted by an opening 15. The opening 15 is aligned with an opening 16 located in the drive gear 2 and enables the insertion of a securing element 17 which fixes the angular position of the clamping gear 4 relative to the drive gear 2.

The camshaft adjuster 1 comprises a harmonic drive 18 as a three-shaft drive. A wave generator 19 of the harmonic drive 18 works with a ball bearing 20 as a roller bearing and causes the deformation of an elastic, toothed gear element, which interacts with internal toothing 21 on the inner peripheral surface of the drive gear 2. A compensating coupling 22 in the form of an Oldham coupling, which comprises an Oldham disc 23 as a compensating element, is also to be attributed to the harmonic drive 18. In an alternative embodiment, not shown, the Oldham disc 23 is omitted, wherein a compensating element is integrated into the electric motor, which actuates the wave generator 19 instead.

In the present case, an electrically driven, two-winged drive element, not shown, which rotates the Oldham disc 23 and thus actuates the wave generator 19, engages in two recesses 24 on the inner peripheral surface of the Oldham disc 23. In this case, the Oldham disc 23 can be displaced to a limited extent relative to the drive element, which is identical to or firmly connected to the rotor of an electric motor. In a direction orthogonal thereto, the Oldham disc 23 can be displaced within defined limits with respect to two pins 25 that are firmly connected to an inner ring of the wave generator 19. Overall, an axial offset between the electric motor, which actuates the wave generator 19, and the central axis of the harmonic drive 18, i.e., the axis of rotation of the shaft adjuster 1 and thus also the axis of rotation of the shaft to be adjusted, can be compensated. In the axial direction, the Oldham disc 23 is set back with respect to the end face of the annular projection 8. The Oldham disc 23 is thus arranged completely within the cavity that is formed by the drive gear 2.

LIST OF REFERENCE SYMBOLS

1 Shaft adjuster
2 Drive gear
3 Spur gear toothing
4 Clamping gear
5 Toothing
6 Spring
7 Tangential groove
8 Annular projection
9 Axial groove
10 First securing end
11 Inner contour
12 Second securing end
13 Recess

14 Torque support contour
15 Opening in the clamping gear
16 Opening in the drive gear
17 Securing element
18 Harmonic drive
19 Wave generator
20 Ball bearing
21 Inner toothing
22 Compensating coupling
23 Oldham disc
24 Recess
25 Pin

The invention claimed is:

1. A camshaft adjuster, comprising:
a drive gear having a spur gear toothing, and
a clamping gear arranged coaxially relative to the drive gear, the clamping gear loaded by a spring acting in a circumferential direction, and
the spring is configured to axially secure the clamping gear on the drive gear.

2. The camshaft adjuster according to claim 1, wherein the spring engages in a tangential groove arranged on an outer peripheral surface of the drive gear, the tangential groove formed in an annular projection of the drive gear, and the annular projection projecting beyond the spur gear toothing in an axial direction.

3. The camshaft adjuster according to claim 2, wherein the clamping gear is arranged in the axial direction between spur gear toothing of the drive gear and the spring.

4. The camshaft adjuster according to claim 3, wherein the tangential groove is interrupted by an axial groove configured to be engaged by a first securing end of the spring, the first securing end directed in a radially inward direction.

5. The camshaft adjuster according to claim 4, wherein the first securing end is drawn inwards, and an inner contour of the first securing end is rounded, with the inner contour configured to engage the axial groove.

6. The camshaft adjuster according to claim 3, wherein the clamping gear has clamping gear toothing and a torque support contour projecting beyond the clamping gear toothing in the axial direction, and the spring is configured to engage the torque support contour.

7. The camshaft adjuster according to claim 6, wherein the torque support contour is interrupted by a first opening arranged in the clamping gear, the first opening: i) configured to receive a securing element, and ii) aligned with a second opening arranged in the drive gear.

8. The camshaft adjuster according to claim 1, wherein a reduction gear configured as a harmonic drive includes internal toothing arranged on an inner peripheral surface of the drive gear.

9. The camshaft adjuster according to claim 8, wherein a compensating coupling of the harmonic drive includes an Oldham disc arranged in an interior space of the harmonic drive enclosed by the drive gear.

10. The camshaft adjuster according to claim 8, wherein an electrical actuation of the harmonic drive is provided by an electric motor having a compensating element.

11. An electromechanical camshaft adjuster, comprising:
a drive gear having a spur gear toothing, and
a clamping gear arranged coaxially relative to the drive gear, the clamping gear biased via a torsion spring arranged within a tangential groove of the drive gear, and
the torsion spring is configured to axially secure the clamping gear on the drive gear, and
the clamping gear is arranged between the spur gear toothing and the torsion spring in an axial direction.

12. The electromechanical camshaft adjuster of claim 11, wherein the tangential groove is interrupted by an axial groove configured to be engaged by a first securing end of the torsion spring, the first securing end directed in a radially inward direction.

13. The electromechanical camshaft adjuster of claim 11, wherein a reduction gear configured as a harmonic drive includes internal toothing arranged on an inner peripheral surface of the drive gear.

14. The electromechanical camshaft adjuster of claim 11, wherein the clamping gear has clamping gear toothing and a torque support contour projecting beyond the clamping gear toothing in an axial direction, and the torsion spring is configured to engage the torque support contour.

15. The electromechanical camshaft adjuster of claim 14, wherein the torque support contour is interrupted by a first opening arranged in the clamping gear, the first opening: i) configured to receive a securing element for fixing an angular position of the clamping gear relative to the drive gear, and ii) aligned with a second opening arranged in the drive gear.

16. An electromechanical camshaft adjuster, comprising:
a drive gear having a spur gear toothing and an annular projection, and
a clamping gear arranged on the annular projection and axially retained on the annular projection via a torsion spring configured to load the clamping gear in a circumferential direction, and
the annular projection having:
internal toothing configured for a harmonic drive, and
a tangential groove configured to receive the torsion spring.

17. The electromechanical camshaft adjuster of claim 16, wherein the tangential groove is interrupted by an axial groove configured to be engaged by a first securing end of the torsion spring, the first securing end directed in a radially inward direction.

18. The electromechanical camshaft adjuster of claim 16, wherein the clamping gear has clamping gear toothing and a torque support contour projecting beyond the clamping gear toothing in an axial direction, and the torsion spring is configured to engage the torque support contour.

19. The electromechanical camshaft adjuster of claim 18, wherein the torque support contour is interrupted by a first opening arranged in the clamping gear, the first opening: i) configured to receive a securing element for fixing an angular position of the clamping gear relative to the drive gear, and ii) aligned with a second opening arranged in the drive gear.

* * * * *